US011185152B2

(12) United States Patent
Wainless et al.

(10) Patent No.: US 11,185,152 B2
(45) Date of Patent: Nov. 30, 2021

(54) ORAL CARE IMPLEMENT

(71) Applicant: Colgate-Palmolive Company, New York, NY (US)

(72) Inventors: Daniel Wainless, New Brunswick, NJ (US); Eduardo Jimenez, Manalapan, NJ (US)

(73) Assignee: Colgate-Palmolive Company, New York, NY (US)

( * ) Notice: Subject to any disclaimer, the term of this patent is extended or adjusted under 35 U.S.C. 154(b) by 189 days.

(21) Appl. No.: 16/491,173

(22) PCT Filed: Mar. 14, 2017

(86) PCT No.: PCT/US2017/022283
§ 371 (c)(1),
(2) Date: Sep. 5, 2019

(87) PCT Pub. No.: WO2018/169518
PCT Pub. Date: Sep. 20, 2018

(65) Prior Publication Data

US 2020/0029679 A1 Jan. 30, 2020

(51) Int. Cl.
*A46B 9/02* (2006.01)
*A46B 9/04* (2006.01)

(52) U.S. Cl.
CPC ..... *A46B 9/026* (2013.01); *A46B 9/04* (2013.01); *A46B 2200/1066* (2013.01)

(58) Field of Classification Search
CPC ..... A46B 9/04; A46B 9/026; A46B 9/028; A46B 9/025; A46B 9/00; A46B 9/02;
(Continued)

(56) References Cited

U.S. PATENT DOCUMENTS 2,043,898 A * 6/1936 Malcolm ..... A46B 9/04 15/167.1
2,978,724 A 4/1961 Coy
(Continued)

FOREIGN PATENT DOCUMENTS

CN 1432321 7/2003
CN 1547441 11/2004
(Continued)

OTHER PUBLICATIONS

International Search Report and Written Opinion of the International Searching Authority in International Application No. PCT/US2017/022283 dated Feb. 2, 2018.

*Primary Examiner* — Joseph J Hail
*Assistant Examiner* — Michael A Gump

(57) ABSTRACT

An oral care implement having an arrangement of tooth cleaning elements thereon. The oral care implement may include a head extending along a longitudinal axis from a proximal end to a distal end. A plurality of tooth cleaning elements extend from the head and are arranged in groups including a first group of tooth cleaning elements that terminate in distal ends that form a concave cleaning surface and a second group of tooth cleaning elements that terminate in distal ends that form a convex cleaning surface. Furthermore, there may also be a third group of tooth cleaning elements extending transversely across the head and dividing the first group of tooth cleaning elements into first and second subgroups of tooth cleaning elements. The third group of tooth cleaning elements may be inclined relative to a surface of the head from which they extend.

19 Claims, 13 Drawing Sheets

(58) Field of Classification Search
CPC . A46B 9/023; A46B 9/045; A46B 2200/1066; A46B 17/00
USPC ..... 15/167.1
See application file for complete search history.

(56) References Cited

U.S. PATENT DOCUMENTS

| | | | | |
|---|---|---|---|---|
| 3,742,549 | A | 7/1973 | Scopp et al. | |
| 5,305,489 | A | 4/1994 | Lage | |
| 5,392,483 | A * | 2/1995 | Heinzelman | A46B 9/04 15/167.1 |
| 5,570,487 | A | 11/1996 | Schneider | |
| 5,655,249 | A | 8/1997 | Li | |
| D387,562 | S | 12/1997 | Brady | |
| 5,881,425 | A | 3/1999 | Hudson et al. | |
| 6,108,851 | A | 8/2000 | Bredall et al. | |
| 6,260,227 | B1 | 7/2001 | Fulop et al. | |
| 6,505,373 | B2 | 1/2003 | Van Gelder et al. | |
| 8,631,534 | B2 | 1/2014 | Blanchard et al. | |
| 9,204,949 | B2 | 12/2015 | Chenvainu et al. | |
| 9,723,912 | B2 | 8/2017 | Chun et al. | |
| 2007/0283518 | A1 * | 12/2007 | Blanchard | A46B 9/04 15/167.1 |
| 2008/0271276 | A1 * | 11/2008 | Garberg | A46D 1/00 15/167.1 |

FOREIGN PATENT DOCUMENTS

| | | |
|---|---|---|
| CN | 101299943 | 11/2008 |
| CN | 102395295 | 3/2012 |
| DE | 3820372 | 12/1989 |
| EP | 0885573 | 12/1998 |
| WO | 1996/001578 | 1/1996 |
| WO | 1997/25898 | 7/1997 |

* cited by examiner

ORAL CARE IMPLEMENT

BACKGROUND

A toothbrush is used to clean the teeth by removing plaque and debris from the tooth surfaces. In typical oral care implements, bristles are bundled together in a bristle tuft and mounted within tuft holes. While substantial efforts have been made to modify the cleaning elements of toothbrushes to improve the efficiency and effectiveness of the oral cleaning process, the industry continues to pursue arrangements of cleaning elements that will improve upon the existing technology. Therefore, a need exists for an oral care implement having an improved arrangement of tooth cleaning elements.

BRIEF SUMMARY

The present invention may be directed, in one aspect, to an oral care implement having an arrangement of tooth cleaning elements thereon. The oral care implement may include a head extending along a longitudinal axis from a proximal end to a distal end. A plurality of tooth cleaning elements extend from the head and are arranged in groups including a first group of tooth cleaning elements that terminate in distal ends that form a concave cleaning surface and a second group of tooth cleaning elements that terminate in distal ends that form a convex cleaning surface. Furthermore, there may also be a third group of tooth cleaning elements extending transversely across the head and dividing the first group of tooth cleaning elements into first and second subgroups of tooth cleaning elements. The third group of tooth cleaning elements may be inclined relative to a surface of the head from which they extend.

In one aspect, the invention may be an oral care implement comprising: a head extending along a longitudinal axis from a proximal end to a distal end, the head comprising a first surface; a plurality of tooth cleaning elements extending from the first surface of the head and arranged in a tooth cleaning element field, the tooth cleaning element field comprising: a first group of tooth cleaning elements, the tooth cleaning elements of the first group terminating in distal ends that collectively form a first cleaning surface that is concave in both a longitudinal direction and a lateral direction; and a second group of tooth cleaning elements located adjacent the first group of tooth cleaning elements, the tooth cleaning elements of the second group terminating in distal ends that collectively form a second cleaning surface that is convex in both a longitudinal direction and a lateral direction.

In another aspect, the invention may be an oral care implement comprising: a head extending along a longitudinal axis from a proximal end to a distal end, the head comprising a first surface; a plurality of tooth cleaning elements extending from the first surface of the head and arranged in a tooth cleaning element field, the tooth cleaning element field comprising: a first group of tooth cleaning elements, the tooth cleaning elements of the first group terminating in distal ends that collectively form a first concave cleaning surface; and a third group of tooth cleaning elements disposed within the first group of tooth cleaning elements and protruding through the first concave cleaning surface, the tooth cleaning elements of the third group extending from the first surface in an inclined manner.

In yet another aspect, the invention may be an oral care implement comprising: a head extending along a longitudinal axis from a proximal end to a distal end, the head comprising a first surface; a plurality of tooth cleaning elements extending from the first surface of the head and arranged in a tooth cleaning element field, the tooth cleaning element field comprising a first group of tooth cleaning elements and a third group of tooth cleaning elements, the third group of tooth cleaning elements dividing the first group of tooth cleaning elements into a first subgroup of tooth cleaning elements and a second subgroup of tooth cleaning elements; and wherein the tooth cleaning elements of the first subgroup of tooth cleaning elements terminate in distal ends that collectively form a cleaning surface that is concave in both a longitudinal direction and a lateral direction and wherein the tooth cleaning elements of the second subgroup of tooth cleaning elements terminate in distal ends that collectively form a cleaning surface that is concave in both the longitudinal direction and the lateral direction.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1:
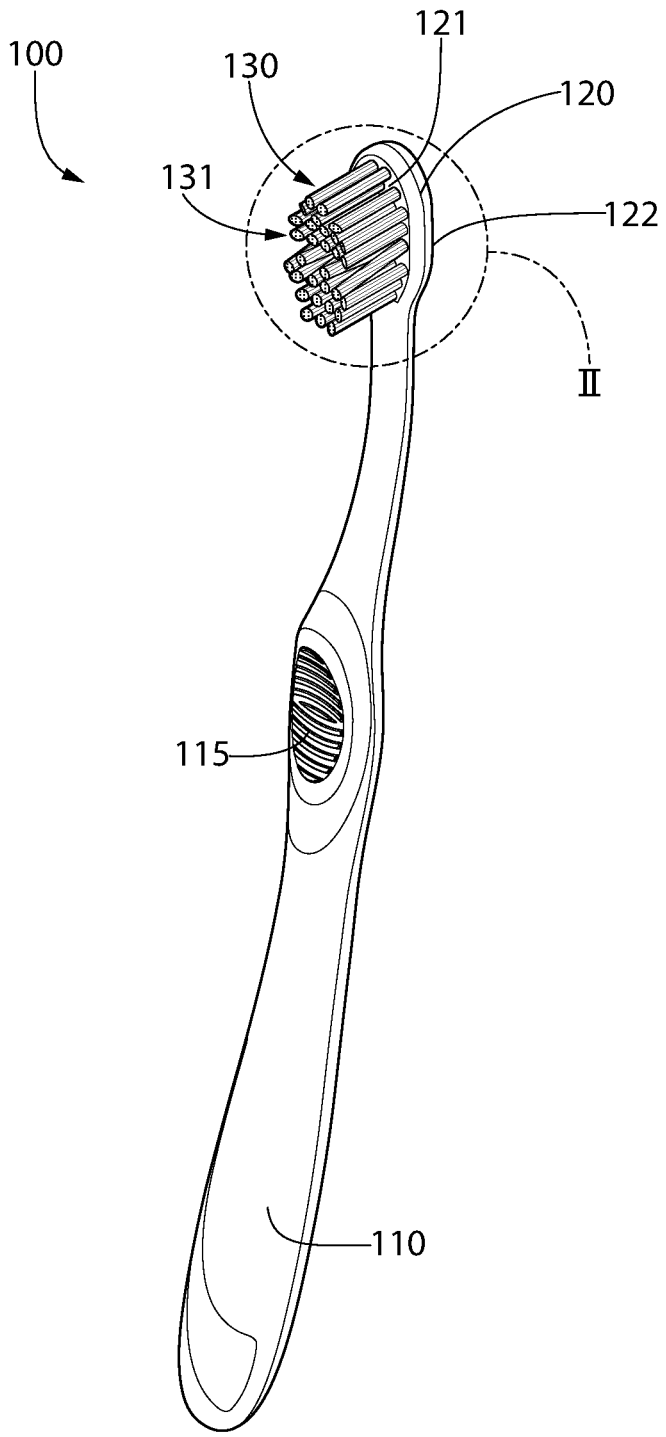
FIG. 1 is perspective view of an oral care implement in accordance with an embodiment of the present invention.
Figure 2:
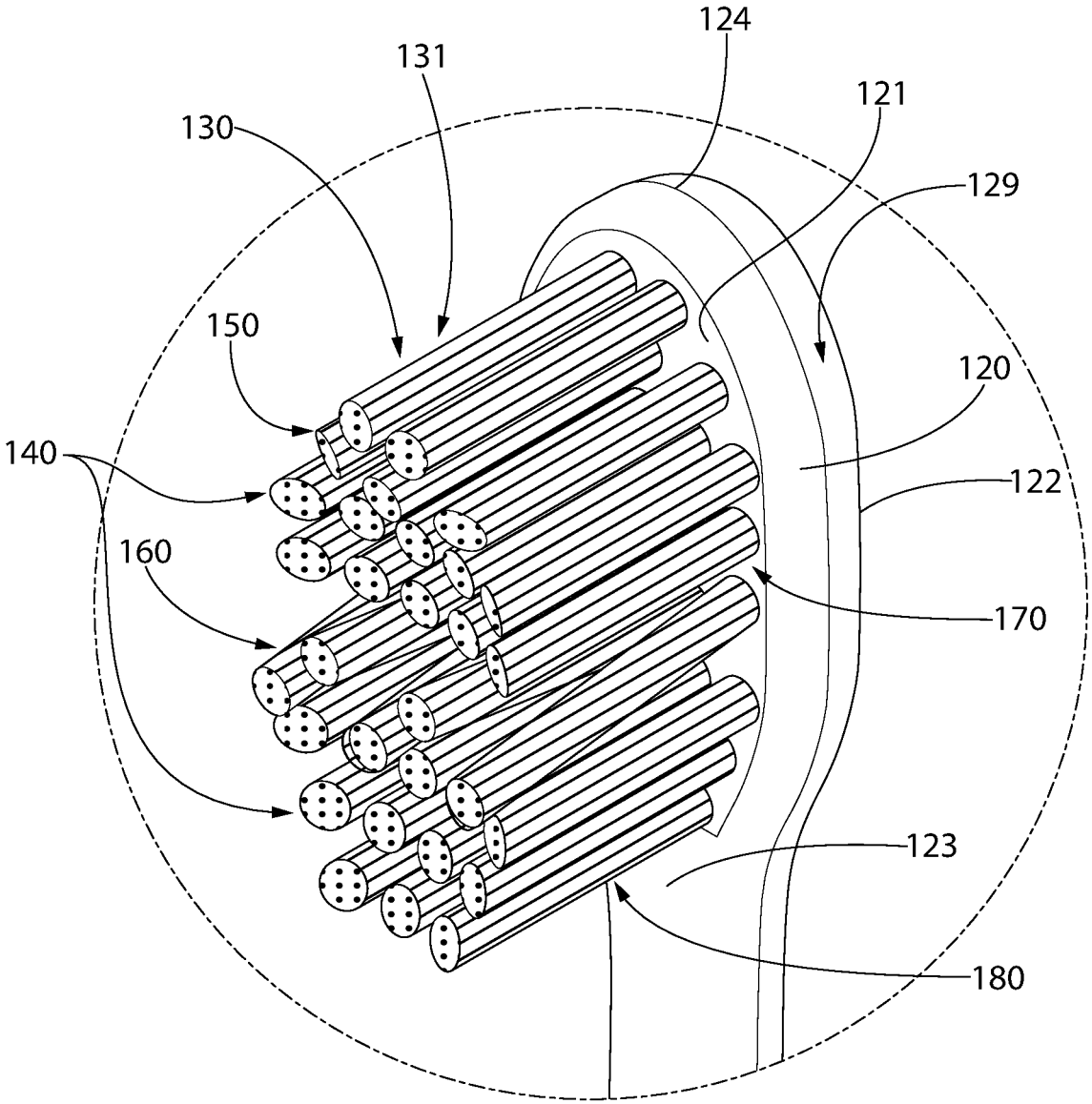
FIG. 2 is a close-up view of area II of FIG. 1 illustrating a head of the oral care implement of FIG. 1.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top," and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

Referring to FIG. 1, an oral care implement 100 is illustrated in accordance with an embodiment of the present invention. In the exemplified embodiment, the oral care implement 100 is illustrated as a manual toothbrush. However, the invention is not to be so limited and the disclosure set forth herein is also applicable to a powered toothbrush. In still other embodiments, the oral care implement 100 can take on other forms such as being a tongue scraper, a gum and soft tissue cleanser, a water pick, an interdental device, a tooth polisher, a specially designed ansate implement having tooth engaging elements or any other type of implement that is commonly used for oral care. Thus, it is to be understood that the inventive concepts discussed herein can be applied to any type of oral care implement unless a specific type of oral care implement is specified in the claims.

The oral care implement 100 generally comprises a handle 110 and a head 120. The head 120 may be formed as a part of a refill head that is detachably coupled to the handle 110. Thus, the head 120 may be detachably coupled to the handle 110 in some embodiments as is standard in the electric toothbrush industry whereby the handles are reused with different refill heads so that the consumer is not required to replace the entire toothbrush including the electronics when the tooth cleaning elements become frayed or damaged and require replacement. In other embodiments, the handle 110 and the head 120 may be integrally formed as a single unitary structure using a molding, milling, machining or other suitable process. In still other embodiments, the handle 110 and the head 120 may be formed as separate components which are operably connected at a later stage of the manufacturing process by any suitable technique known in the art, including without limitation thermal or ultrasonic welding, a tight-fit assembly, a coupling sleeve, threaded engagement, adhesion, or fasteners.

The head 120 and the handle 110 are typically formed of a rigid plastic material, such as for example without limitation polymers and copolymers of ethylene, propylene, butadiene, vinyl compounds and polyesters such as polyethylene terephthalate. Of course, the invention is not to be so limited in all embodiments and the handle 110 may include a resilient material, such as a thermoplastic elastomer, as a grip cover that is molded over portions of or the entirety of the handle 110 to enhance the gripability of the handle 110 during use. In the exemplified embodiment, the handle 110 comprises a thumb grip 115 that is formed from an elastomeric material. Additionally, portions of the handle 110 that are typically gripped by a user's palm during use may be overmolded with a thermoplastic elastomer or other resilient material to further increase comfort to a user during handling of the oral care implement 100.

Referring to FIGS. 1-5 concurrently, the head 120 comprises a front surface 121 and an opposing rear surface 122. Furthermore, the head 120 has a peripheral surface 129 extending between the front and rear surfaces 121, 122 along the periphery of the head 120. The peripheral surface 129 forms opposing lateral sides of the head 120. In the exemplified embodiment each of the front and rear surfaces 121, 122 is a flat, planar surface although this is not required in all embodiments and the front and/or rear surfaces 121, 122 may have slopes, inclines, contours, or the like in other embodiments. The head 120 of the oral care implement 100 extends along a longitudinal axis A-A from a proximal end 123 that is adjacent the handle 110 to a distal end 124 that is remote from the handle 110. In the exemplified embodiment, a plurality of tooth cleaning elements 130 extend from the front surface 121 of the head 120. The plurality of tooth cleaning elements 130 are arranged in a tooth cleaning element field 131 and comprise several separate groups of tooth cleaning elements, which will be described in more detail below. Although not illustrated, in certain embodiments a soft tissue or tongue cleanser may be coupled to or positioned on the rear surface 122 of the head 120.

Although certain details are provided below with regard to the different groups of tooth cleaning elements that are coupled to the head 120, in certain embodiments the exact structure, pattern, orientation, and material of the tooth cleaning elements 130 is not to be limiting of the present invention unless so specified in the claims. Thus, unless otherwise described herein, the term "tooth cleaning elements" may refer to any structure that can be used to clean, polish or wipe the teeth and/or soft oral tissue (e.g. tongue, cheek, gums, etc.) through relative surface contact. Common examples of types of tooth cleaning elements may include, without limitation, bristle tufts, filament bristles, fiber bristles, nylon bristles, end-rounded bristles, core-sheath bristles, crimped bristles, spiral bristles, tapered bristles, rubber bristles, elastomeric protrusions, flexible polymer protrusions, combinations thereof and/or structures containing such materials or combinations. Suitable elastomeric materials for elastomeric protrusions may include any biocompatible resilient material suitable for uses in an oral hygiene apparatus. To provide optimum comfort as well as cleaning benefits, the elastomeric material of the tooth or soft tissue engaging elements has a hardness property in the range of A8 to A25 Shore hardness. One suitable elastomeric material is styrene-ethylene/butylene-styrene block copolymer (SEBS) manufactured by GLS Corporation. Nevertheless, SEBS material from other manufacturers or other materials within and outside the noted hardness range could be used.

The tooth cleaning elements 130 can be connected to the head 120 in any manner known in the art. For example, staples/anchors, in-mold tufting (IMT), anchor free tufting (AFT), or PTt could be used to mount the tooth cleaning elements 130 to the head 120. In certain embodiments, the invention can be practiced with various combinations of stapled, IMT, AFT, or PTt mounted bristles. In staple technologies, the tooth cleaning elements 130, such as bristles, are bent into a U-shape, clustered together into a tuft of bristles, and then the bight portion of the tuft of bristles is inserted into a tuft hole in the head 120. A staple is then inserted into the tuft hole to engage the bight portion of the tuft of bristles and secure the tuft of bristles to the head 110. In AFT, bristles are inserted through openings in a plate that is a separate structure from the brush head. The free ends of the bristles on one side of the plate perform the cleaning function. The ends of the bristles on the other side of the plate are melted together by heat to be anchored in place. After the ends of the bristles are melted together, the plate is secured to the brush head such as by ultrasonic welding. PTt is a newer technology that involves arranging the filaments into a tuft, fusing one end of the tuft, placing the tuft in a blind hole of a toothbrush head, and then applying heat and pressure to the surface of the toothbrush head to close the blind hole around the fused end of the tuft to firmly retain the tuft therein.

As noted above, the plurality of tooth cleaning elements 130 are arranged in groups within the tooth cleaning element field 131. Specifically, the tooth cleaning element field 131 comprises a first group of tooth cleaning elements 140, a second group of tooth cleaning elements 150, and a third group of tooth cleaning elements 160. It should be noted that the terms "first," "second," and "third" preceding a particular group of tooth cleaning elements is used consistently throughout the specification and claims to refer to that specific group of tooth cleaning elements. In some embodiments, the oral care implement 100 may include only the first and second groups of tooth cleaning elements 140, 150. In other embodiments, the oral care implement may include only the first and third groups of tooth cleaning elements 140, 160 or only the second and third groups of tooth cleaning elements 150, 160. Even if only the first and third groups of tooth cleaning elements 140, 160 are recited in a claim, the terms "first" and "third" are used even though the term "second" is not used. As noted above, this is done for consistency and should be readily understood. Thus, the inclusion of the "third" group of tooth cleaning elements does not mean that a "second" group of tooth cleaning elements necessarily exists in that claimed embodiment. Rather, there could be only a "first" group and a "third" group in some embodiments.

Figure 3:
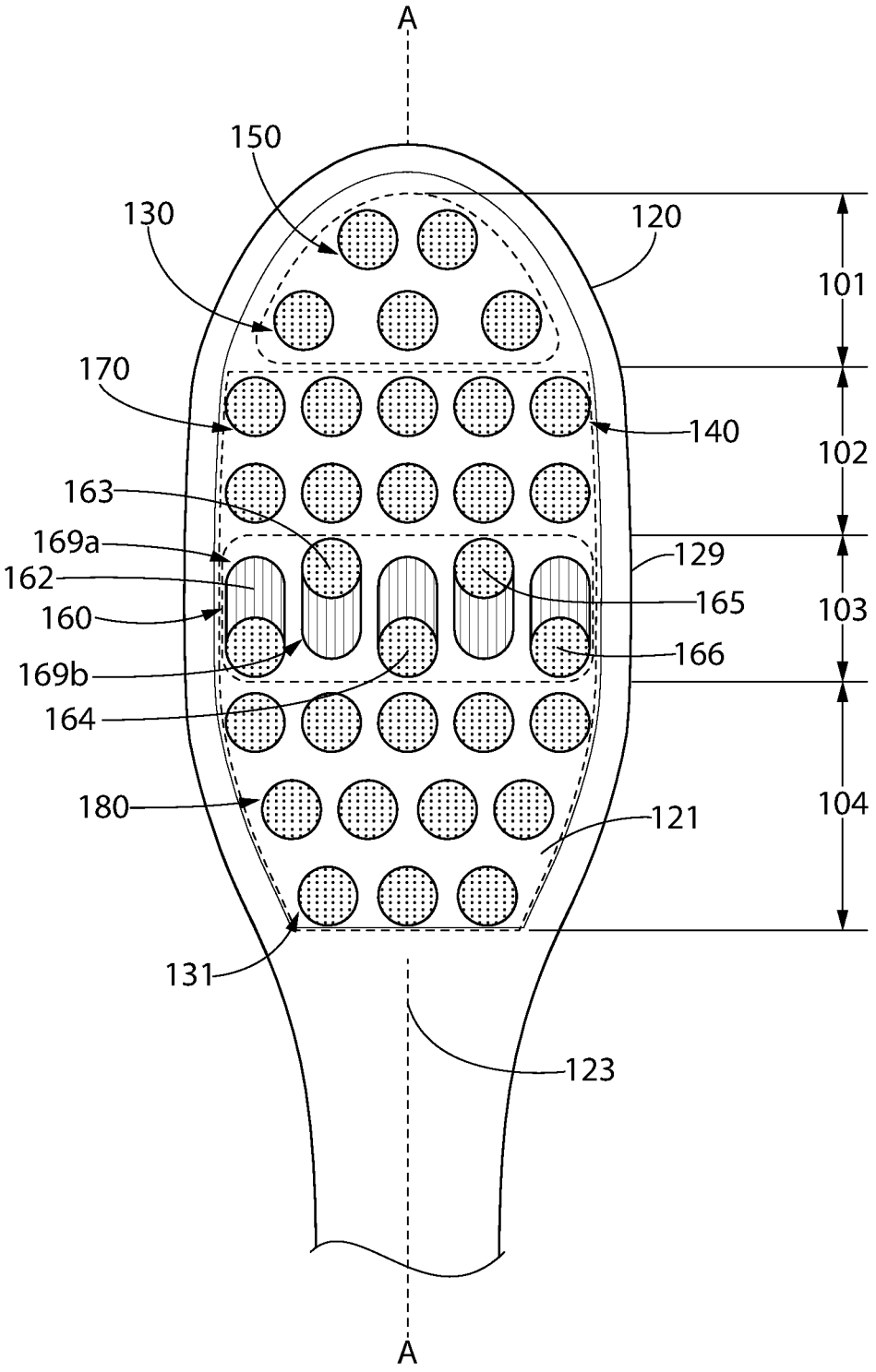
FIG. 3 is a front view of the head of the oral care implement of FIG. 1.

In FIG. 3, each of the groups of tooth cleaning elements 140, 150, 160 is encircled by a dashed-line to provide clarity regarding which of the tooth cleaning elements is included within each group. As can be seen in FIG. 3 and described in more detail below, the third group of tooth cleaning elements 160 is disposed within the first group of tooth cleaning elements 140 and divides the first group of tooth cleaning elements 140 into a first subgroup of tooth cleaning elements 170 and a second subgroup of tooth cleaning elements 180. Despite the third group of tooth cleaning elements 160 being located within the first group of tooth cleaning elements 140, the first and third groups of tooth cleaning elements 140, 160 are readily distinguishable from one another based on their angle of extension from the front surface 121 of the head 120, the shape of the cleaning profiles formed by the distal ends of the tooth cleaning elements of those groups, and/or their color, as discuss in more detail below.

In the exemplified embodiment, each of the first, second, and third groups of tooth cleaning elements 140, 150, 160 are formed by a plurality of tufts of bristles. Each tuft of bristles comprises a plurality of bristles that are clustered together and inserted into a single tuft hole in the head 120 and secured to the head 120 using one of the techniques described above. Of course, the invention is not to be so limited in all embodiments and in alternative embodiments some of the tooth cleaning elements of one or more of the first, second, and third groups of tooth cleaning elements 140, 150, 160 may be formed by elastomeric members rather than tufts of bristles. Thus, various combinations of bristle tufts and elastomeric members extending from the front surface 121 of the head 120 are possible in different embodiments.

As stated above, in the exemplified embodiment each of the tooth cleaning elements 130 extends from the front surface 121 of the head 120. In one embodiment, the various groups described herein may be distinguished based on the positioning or location of the tooth cleaning elements of that group on the front surface 121 of the head 120. Specifically, in the exemplified embodiment the second group of tooth cleaning elements 150 is located adjacent to the distal end 124 of the head 120, the first group of tooth cleaning elements 140 is located between the second group of tooth cleaning elements 150 and the proximal end of the head 120, and the third group of tooth cleaning elements 160 is located within the first group of tooth cleaning elements 140.

More specifically, in the exemplified embodiment the third group of tooth cleaning elements 160 extends transversely across the head 120 along an entirety of a width of the cleaning element field 131 to divide the first group of tooth cleaning elements 140 into the first subgroup of tooth cleaning elements 170 and the second subgroup of tooth cleaning elements 180. In the exemplified embodiment, the first subgroup of tooth cleaning elements 170 is located between the second group of tooth cleaning elements 150 and the third group of tooth cleaning elements 160 and the second subgroup of tooth cleaning elements 180 is located between the third group of tooth cleaning elements 160 and the proximal end 123 of the head 120.

Stated another way, the tooth cleaning element field 131 of the head 120 may be conceptually divided into four axial sections including a first axial section 101, a second axial section 102, a third axial section 103, and a fourth axial section 104. Each of the axial sections 101-104 encompasses a portion of the axial length of the head 120 and an entirety of a lateral width of the head 120 along that portion of the axial length. The first axial section 101 is closest to the distal end 124 of the head 120, the second axial section 102 is between the first axial section 101 and the third axial section 103, the third axial section 103 is between the second axial section 102 and the fourth axial section 104, and the fourth axial section is adjacent the proximal end 123 of the head 120.

In the exemplified embodiment, the first axial section 101 of the tooth cleaning element field 131 has only the second group of tooth cleaning elements 150 and none of the tooth cleaning elements of the first and third groups 140, 160. Furthermore, the second axial section 102 of the tooth cleaning element field 131 has only the first subgroup of tooth cleaning elements 170 of the first group of tooth cleaning elements 140 and none of the tooth cleaning elements of the second subgroup 180, the second group 150, and the third group 160. The third axial section 103 of the tooth cleaning element field 131 has only the third group of tooth cleaning elements 160 and none of the tooth cleaning elements of the first and second groups 140, 150. Finally, the fourth axial section 104 of the tooth cleaning element field 131 has only the second subgroup of tooth cleaning elements 180 of the first group of tooth cleaning elements 140 and none of the tooth cleaning elements of the first subgroup 170, the second group 150, and the third group 160.

Although the groups of tooth cleaning elements 140, 150, 160 are described herein and illustrated in the accompanying drawings as being positioned at specific locations on the head 120, the invention is not to be so limited in all embodiments. Thus, in some embodiments the groups of tooth cleaning elements 140, 150, 160 may be positioned at locations on the head 120 other than that which is shown in the drawings. For example, the second group of tooth cleaning elements 150 could be adjacent the proximal end 123 of the head 120 and the first group of tooth cleaning elements 140 adjacent the distal end 124 of the head 120. Other permutations in tooth cleaning element group location on the head 120 are also possible.

As can be seen in FIG. 3 and as will be described in greater detail below, in the exemplified embodiment each of the tooth cleaning elements of the first and second groups 140, 150 extends perpendicular from the front surface 121 of the head 120. Of course, the invention is not to be so limited in all embodiments and in alternative embodiments one or more of the tooth cleaning elements of the first and second groups 140, 150 may be oriented obliquely (non-perpendicular) to the front surface 121 of the head 120. Furthermore, in the exemplified embodiment each of the tooth cleaning elements of the third group 160 extends from the front surface 121 of the head 120 at an incline or at an oblique angle relative to the front surface 121 of the head 120. Specifically, the tooth cleaning elements of the third group 160 are oriented such that, moving transversely across the head 120 (from one lateral side to the opposite lateral side), adjacent ones of the tooth cleaning elements of the third group 160 are inclined in opposing directions either towards the proximal end 123 of the head 120 (and towards the handle 110) or towards the distal end 124 of the head 120 (and away from the handle 110). This will be discussed in more detail below with reference to FIGS. 3 and 13-15.

Figure 4:
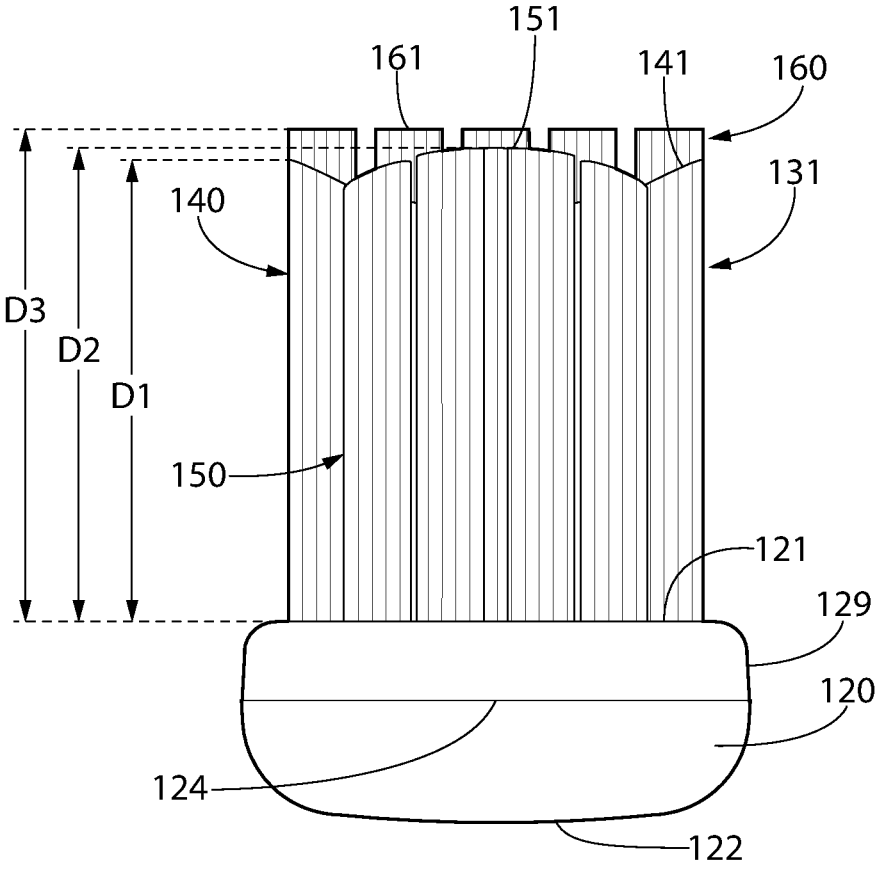
FIG. 4 is a top view of the head of the oral care implement of FIG. 1.
Figure 5:
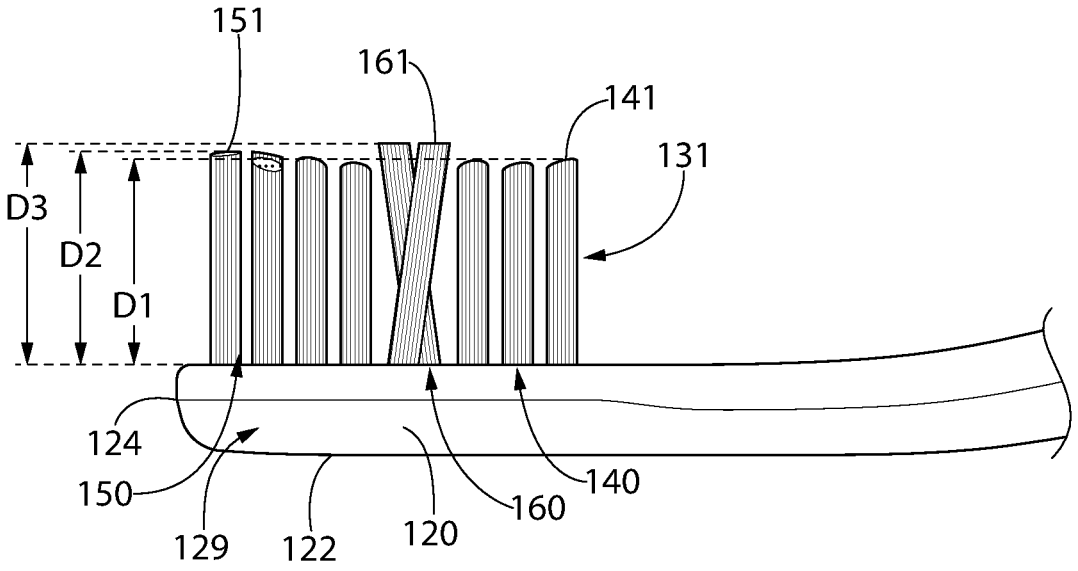
FIG. 5 is a side view of the head of the oral care implement of FIG. 1.
Figure 6:
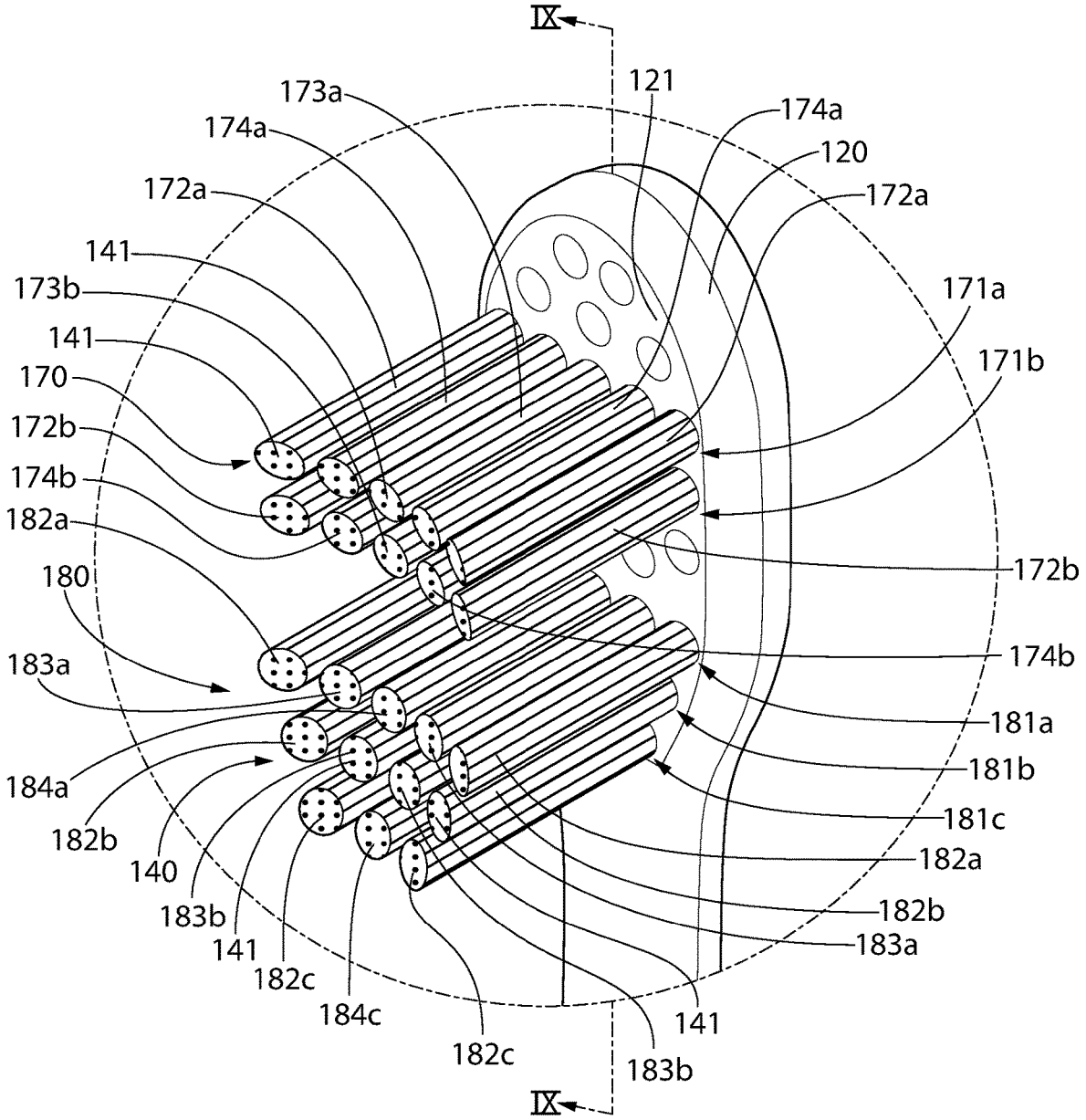
FIG. 6 is a perspective view of the head of the oral care implement of FIG. 1 with only a first group of cleaning elements thereon.

Referring to FIGS. 4 and 5, the relative heights of the tooth cleaning elements in each of the first, second, and third groups of tooth cleaning elements 140, 150, 160 will be further described. The tooth cleaning elements of the first group 140 extend from the front surface 121 of the head 120 and terminate at distal ends 141. The tooth cleaning elements of the second group 150 extend from the front surface 121 of the head 120 and terminate at distal ends 151. The tooth cleaning elements of the third group 160 extend from the front surface 121 of the head 120 and terminate at distal ends 161. Only the distal ends 141, 151, 161 of one of the tooth cleaning elements within each of the first, second, and third groups 140, 150, 160 is labeled in FIGS. 4 and 5 to avoid clutter, it being understood that each tooth cleaning element in each respective group terminates in one of the distal ends 141, 151, 161. Specifically, for purposes of discussing the heights of the tooth cleaning elements in each group, only the tallest tooth cleaning element in each of the first, second, and third groups 140, 150, 160 has its distal end 141, 151, 161 labeled in FIGS. 4 and 5.

The height of each of the tooth cleaning elements 130 is defined by the distance measured between the front surface 121 of the head 120 and the distal end 141, 151, 161 of that particular tooth cleaning element. In the exemplified embodiment, the tooth cleaning elements within a single group do not necessarily have the same height and this will be discussed in more detail below in some detail. Specifically, in the exemplified embodiment all of the tooth cleaning elements of the third group of tooth cleaning elements 160 have the same height, but the tooth cleaning elements of the first group 140 and the tooth cleaning elements of the second group 150 do not all have the same height. Thus, in the exemplified embodiment a tallest one of the tooth cleaning elements of the first group 140 extends a first distance D1 from the front surface 121 of the head 120 to the distal end 141 of that tooth cleaning element. Furthermore, a tallest one of the tooth cleaning elements of the second group 150 extends a second distance D2 from the front surface 121 of the head 120 to the distal end 151 of that tooth cleaning element. Each of the tooth cleaning elements of the third group 160 extends a third distance D3 from the front surface 121 of the head 120 to the distal end 161 of the tooth cleaning elements of the third group 160.

In the exemplified embodiment, the third distance D3 is greater than each of the first and second distances D1, D2. Thus, because each of the tooth cleaning elements of the third group 160 has the same height, each of the tooth cleaning elements of the third group 160 is taller than the tallest ones of the tooth cleaning elements of the first and second groups 140, 150. Stated another way, each of these tooth cleaning elements of the third group 160 is taller than each of the tooth cleaning elements of the first and second groups 140, 150. Furthermore, in the exemplified embodiment the second distance D2 is greater than the first distance D1. Thus, the tallest one of the tooth cleaning elements of the second group 150 is taller than the tallest one of the tooth cleaning elements of the first group 140.

Figure 7:
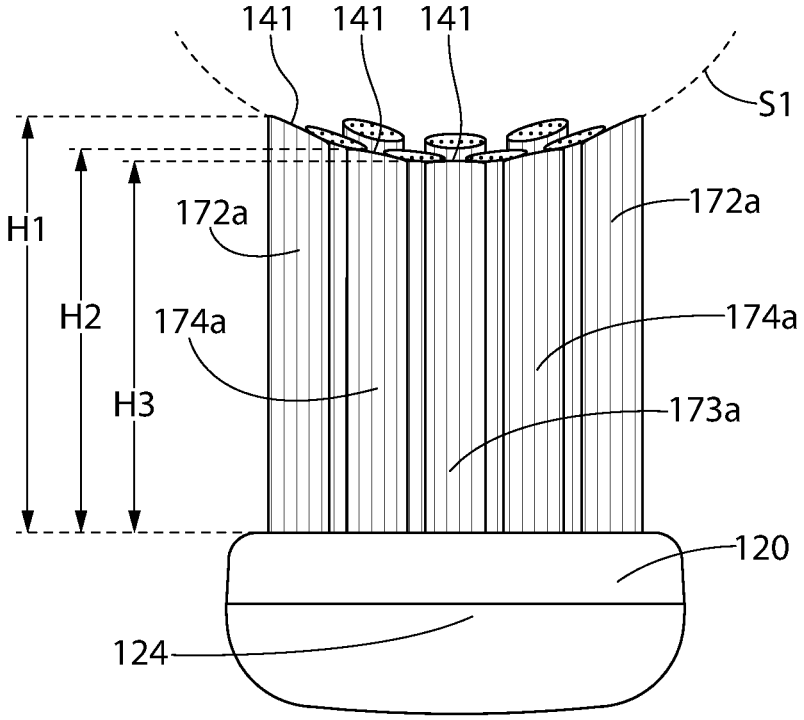
FIG. 7 is a top view of the head of the oral care implement of FIG. 1 with only the first group of cleaning elements thereon.
Figure 8:
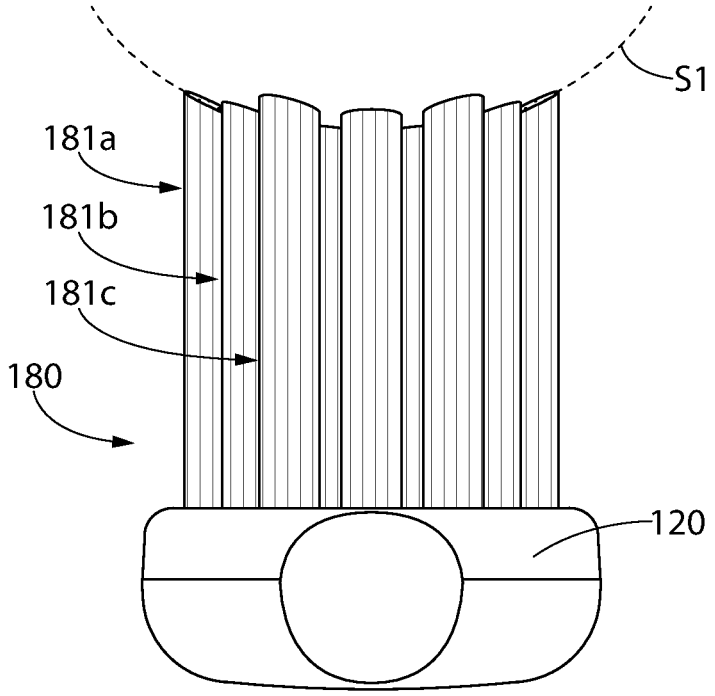
FIG. 8 is a bottom view of the head of the oral care implement of FIG. 1 with only the first group of cleaning elements therein.
Figure 9:
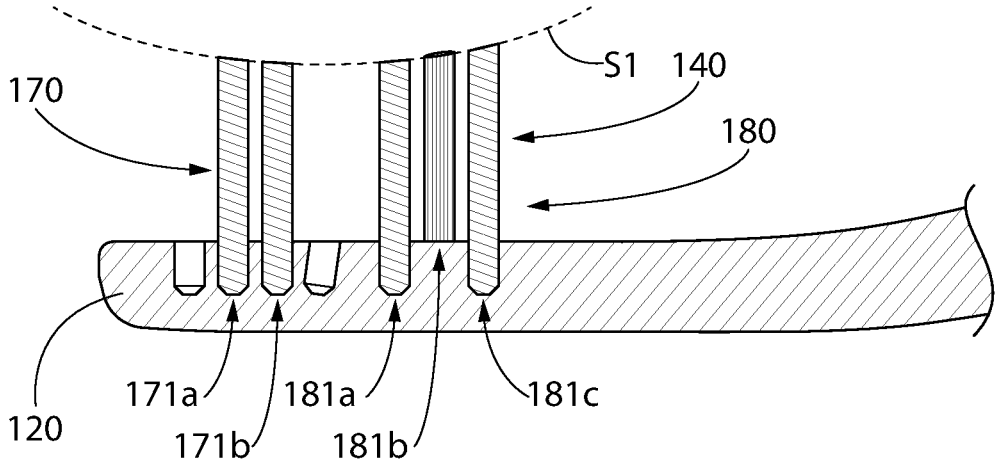
FIG. 9 is a schematic cross-sectional view of FIG. 6 taken along line IX-IX in FIG. 6 with most of the cleaning elements that would be visible in the background omitted.

Referring to FIGS. 6-9, the first group of tooth cleaning elements 140 will be described in greater detail. In FIGS. 6-9 only the first group of tooth cleaning elements 140 is illustrated on the head 120, the second and third groups of tooth cleaning elements 150, 160 having been removed to avoid clutter while describing the first group of tooth cleaning elements 140. As noted above, the tooth cleaning elements of the first group 140 terminate in distal ends 141, only some of which are labeled to avoid clutter. The distal ends 141 of the tooth cleaning elements of the first group 140 collectively form a cleaning surface S1 that is concave in both a longitudinal direction (i.e., in a direction of the longitudinal axis A-A) and in a lateral direction (i.e., in a direction transverse to the longitudinal axis A-A). This cleaning surface S1 is illustrated in FIGS. 7-9. The cleaning surface S1 is the continuous surface formed by the distal ends 141 of the tooth cleaning elements of the first group 140 and the empty space between the distal ends 141 of adjacent ones of the tooth cleaning elements of the first group 140. Thus, if a flat and flexible object were placed into contact with the distal ends 141 of each and every one of the tooth cleaning elements of the first group 140, the object would be concave in both the lateral and longitudinal directions. In fact, the object would take on a dome-like shape with the surface of the dome that is exposed to a viewer looking down at the front surface 121 of the head 120 being concave.

FIGS. 7 and 8 illustrate that the cleaning surface S1 formed collectively by the distal ends 141 of the tooth cleaning elements of the first group 140 is concave in the lateral direction. FIG. 9 illustrates that the cleaning surface S1 formed collectively by the distal ends 141 of the tooth cleaning elements of the first group 140 is concave in the longitudinal direction. The dome-like shape of the cleaning surface S1 in the lateral and longitudinal directions is achieved by varying the heights of the tooth cleaning elements of the first group 140, as discussed in greater detail below.

As noted above, the first group of tooth cleaning elements 140 may be divided into a first subgroup of tooth cleaning elements 170 and a second subgroup of tooth cleaning elements 180. This division of the first group of tooth cleaning elements 140 occurs in the exemplified embodiment due to the third group of tooth cleaning elements 160 being located between the first and second subgroups 170, 180 and isolating the first and second subgroups 170, 180 from one another as best seen in FIG. 3.

In the exemplified embodiment, the first subgroup of tooth cleaning elements 170 comprises two rows (a first row 171*a* and a second row 171*b*) of tooth cleaning elements that are in axial alignment. The first and second rows 171*a*, 171*b* (and all rows described herein) extend transverse to the longitudinal axis A-A of the head 120. Each of the tooth cleaning elements of the first row 171*a* is axially aligned with one of the tooth cleaning elements in the second row 171*b*. Each of the first and second rows 171*a*, 171*b* comprises peripheral cleaning elements 172*a*, 172*b* located adjacent the peripheral sides of the head 120, a central cleaning element 173*a*, 173*b* located on the longitudinal axis A-A of the head 120, and intermediate cleaning elements 174*a*, 174*b* located between the peripheral and central cleaning elements 172*a*, 172*b*, 173*a*, 173*b*. The tooth cleaning elements of each of the first and second rows 171*a*, 171*b* terminate in distal ends that form a concave surface in the lateral direction. The tooth cleaning elements of the first and second rows 171*a*, 171*b* terminate in distal ends that collectively form a concave surface in the longitudinal direction.

FIG. 7 illustrates the head 120 with only the first group of tooth cleaning elements 140 thereon when viewed from the distal end 124 of the head 120. In this view, the first row 171*a* of the first subgroup of tooth cleaning elements 170 is visible and blocks the second row 171*b* of the first subgroup of tooth cleaning elements 170 from view. This is because each cleaning element of the first row 170*a* is slightly taller than each cleaning element of the second row 170*b*. As should be appreciated, this facilitates the formation of the cleaning surface S1 being concave in the longitudinal direction. A discussion of the heights of the various cleaning elements of the first row 171*a* relative to one another is provided below. It should be appreciated that the same discussion applies to the second row 171*b* with regard to the relative heights of the cleaning elements within the second row 171*b* although each cleaning elements of the second row 171*b* may simply be slightly shorter than the cleaning element of the first row 171*a* with which it is axially aligned. Specifically, the peripheral cleaning elements 172*b* are slightly shorter than the peripheral cleaning elements 172*a*, the central cleaning element 173*b* is slightly shorter than the central cleaning element 173*a*, and the intermediate cleaning elements 174*b* are slightly shorter than the intermediate cleaning elements 174*a*).

The peripheral cleaning elements 172*a* of the first row 171*a* have a height H1 measured from the front surface 121 of the head 120 to the distal ends 141 of the peripheral cleaning elements 172*a*. The intermediate cleaning elements 174*a* of the first row 171*a* have a height H2 measured from the front surface 121 of the head 120 to the distal ends 141 of the intermediate cleaning elements 174*a*. The central cleaning element 173*a* of the first row 171*a* have a height H3 measured from the front surface 121 of the head 120 to the distal end 141 of the central cleaning element 173*a*. The height H1 of the peripheral cleaning elements 172*a* is greater than the height H2 of the intermediate cleaning elements 174*a*, which in turn is greater than the height H3 of the central cleaning elements 173*a*. This is also applicable to the second row 171*b* and the relative heights of the peripheral, intermediate, and central cleaning elements 172*b*, 173*b*, 174*b* of the second row 171*b*. As a result, the distal ends 141 of the tooth cleaning elements of the first subgroup 170 collectively form a portion of the cleaning surface S1 that is concave in a lateral direction. Stated another way, the distal end 141 of the tooth cleaning elements of the first subgroup 170 form a concave profile when viewed from the distal 124 or proximal 123 ends of the head 120.

Furthermore, as noted above and as best illustrated in FIG. 9, the tooth cleaning elements of the first row 171*a* are slightly taller than the tooth cleaning elements of the second row 171*b*. As a result, the tooth cleaning elements of the first subgroup 170 also form a portion of the cleaning surface S1 that is concave in the longitudinal direction. Stated another way, the tooth cleaning elements of the first subgroup 170 form a concave profile when viewed from the side of the head 120.

In the exemplified embodiment, the second subgroup of tooth cleaning elements 180 of the first group of tooth cleaning elements 140 comprises a first row 181*a*, a second row 181*b*, and a third row 181*c*. The first row 181*a* is closest to the first subgroup of tooth cleaning elements 170 and has an identical arrangement and relative height of tooth cleaning elements as the first and second rows 171*a*, 171*b* of the first subgroup of tooth cleaning elements 170. Specifically, the first row 181*a* has peripheral cleaning elements 182*a* having a greater height than intermediate cleaning elements 184*a*, which in turn have a greater height than a central cleaning element 183*a*. The second row 181*b* has peripheral cleaning elements 182*b* having a height that is greater than intermediate cleaning elements 184*b*. The third row 181*c* has peripheral cleaning elements 182*c* having a height greater a central cleaning element 184*c*. Furthermore, as best illustrated in FIG. 9, the tooth cleaning elements of the third row 181*c* are generally taller than the tooth cleaning elements of the second row 181*b*, which in turn are generally taller than the tooth cleaning elements of the first row 181*a*. Thus, the distal ends of the tooth cleaning elements of each row 181*a-c* form separate concave surfaces in the lateral direction and the distal ends of the tooth cleaning elements of the rows 181*a*-181*c* collectively form a concave surface in the longitudinal direction.

As a result of the variation in height among and between the cleaning elements of the second subgroup of tooth cleaning element 180, the distal ends 141 of the second subgroup of tooth cleaning elements 180 collectively form a portion of the cleaning surface S1 that is concave in both the longitudinal direction and the lateral direction. Specifically, the variation in height within a single row facilitates the cleaning surface S1 being concave in the lateral direction or when viewed from the proximal or distal ends 123, 124 of the head 120 (see FIG. 8). The variation in height from one row to another facilitates the cleaning surface S1 being concave in the longitudinal direction or when viewed from the side of the head 120 (see FIG. 9).

Thus, as discussed above, the tooth cleaning elements of the first group, when viewed as a whole, terminate in the distal ends 141 that collectively form the cleaning surface S1 that is concave in both the longitudinal direction and the lateral direction. Separately, the first subgroup of tooth cleaning elements 170 terminate in the distal ends 141 that collectively form a portion of the cleaning surface S1 that is concave in both the longitudinal direction and the lateral direction and the second subgroup of tooth cleaning elements 180 terminate in the distal ends 141 that collectively form another portion of the cleaning surface S1 that is concave in both the longitudinal direction and the lateral direction.

In the exemplified embodiment, the concave cleaning surface S1 is even further defined by forming the distal ends 141 of the tooth cleaning elements of the first group 140 so as to be slightly curved, rounded, or otherwise angled relative to the front surface 121 of the head 120. Specifically, if the distal ends 141 were flat and parallel to the front surface 121 of the head 120, the cleaning surface S1 could not be a smooth concave surface. By curving, rounding, or otherwise angling the distal ends 141 of the tooth cleaning elements of the first group 140, the concave nature of the cleaning surface S1 is further enhanced.

Figure 10:
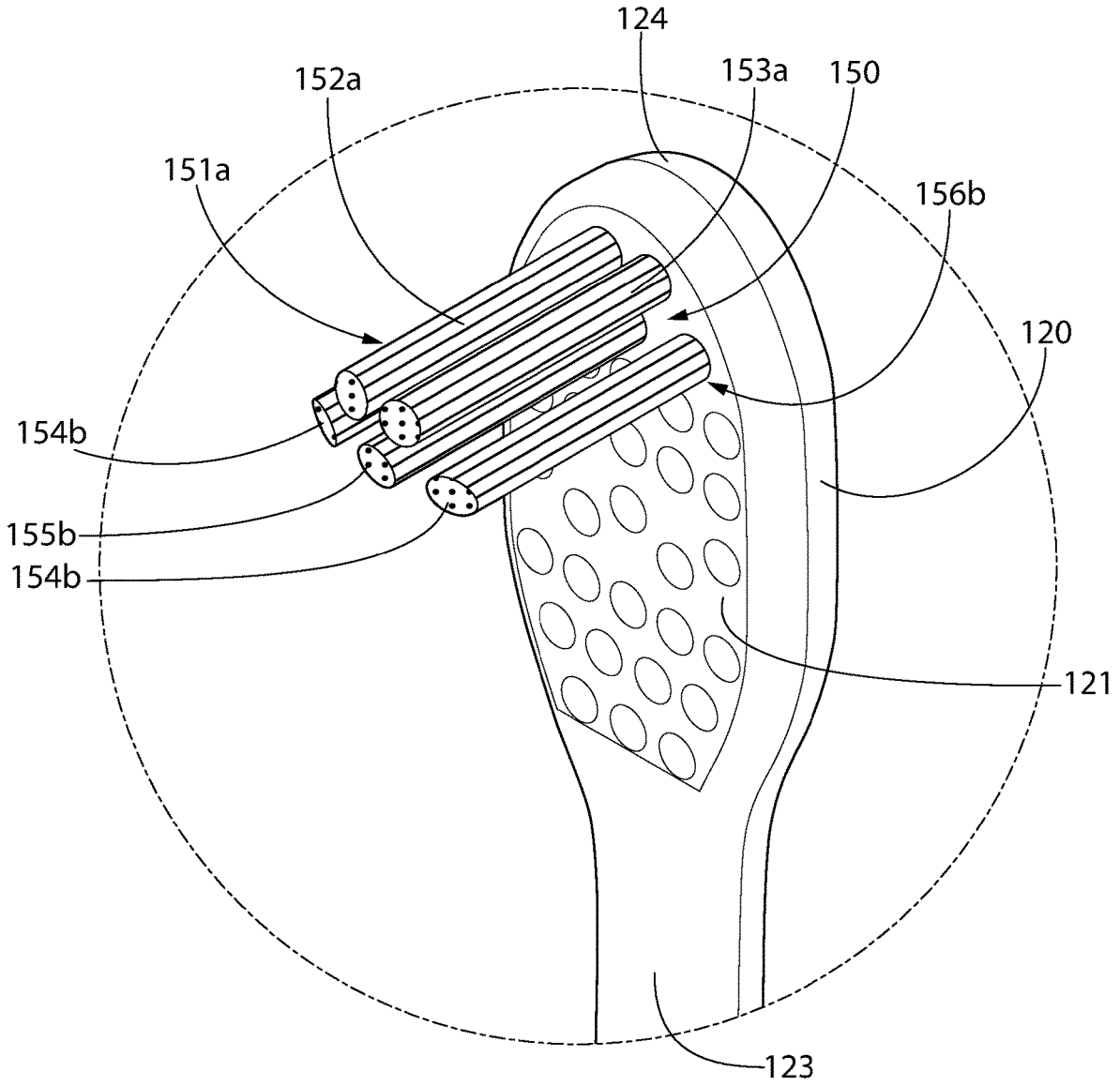
FIG. 10 is a perspective view of the head of the oral care implement of FIG. 1 with only a second group of cleaning elements thereon.
Figure 11:
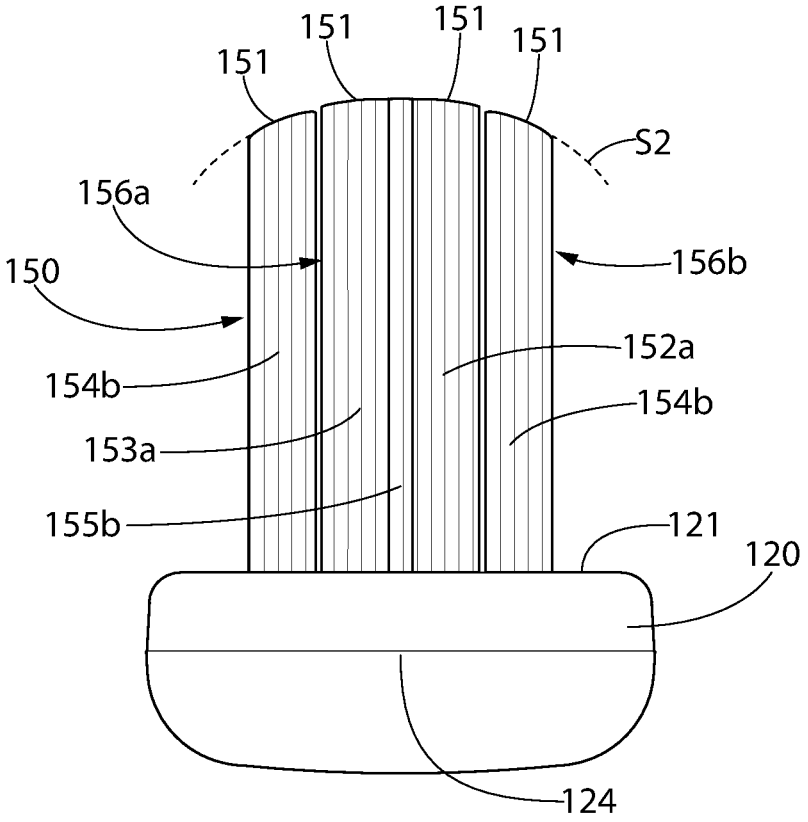
FIG. 11 is a top view of the head of the oral care implement of FIG. 1 with only the second group of cleaning elements thereon.
Figure 12:
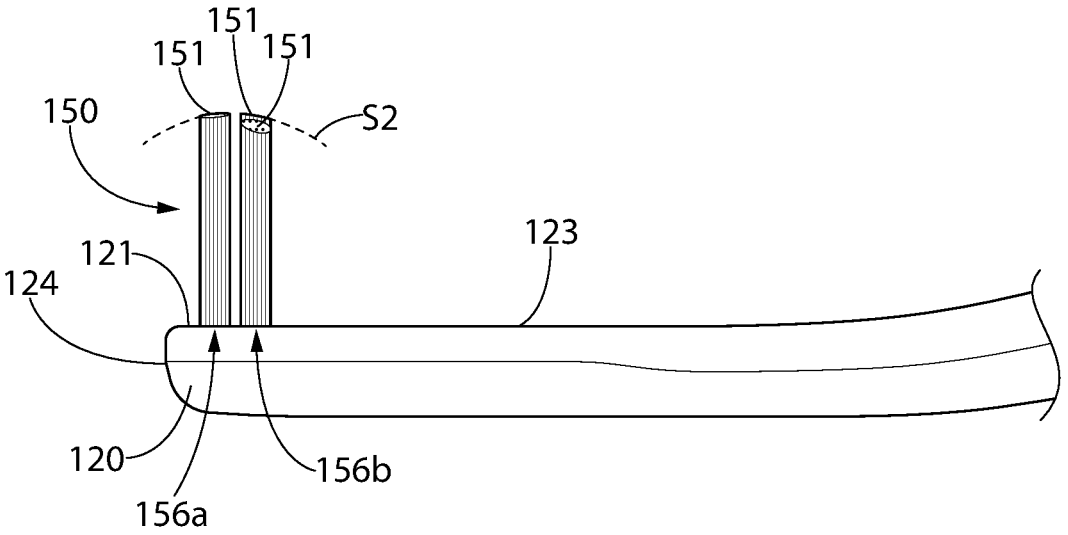
FIG. 12 is a side view of the head of the oral care implement of FIG. 1 with only the second group of cleaning elements thereon.
Figure 13:
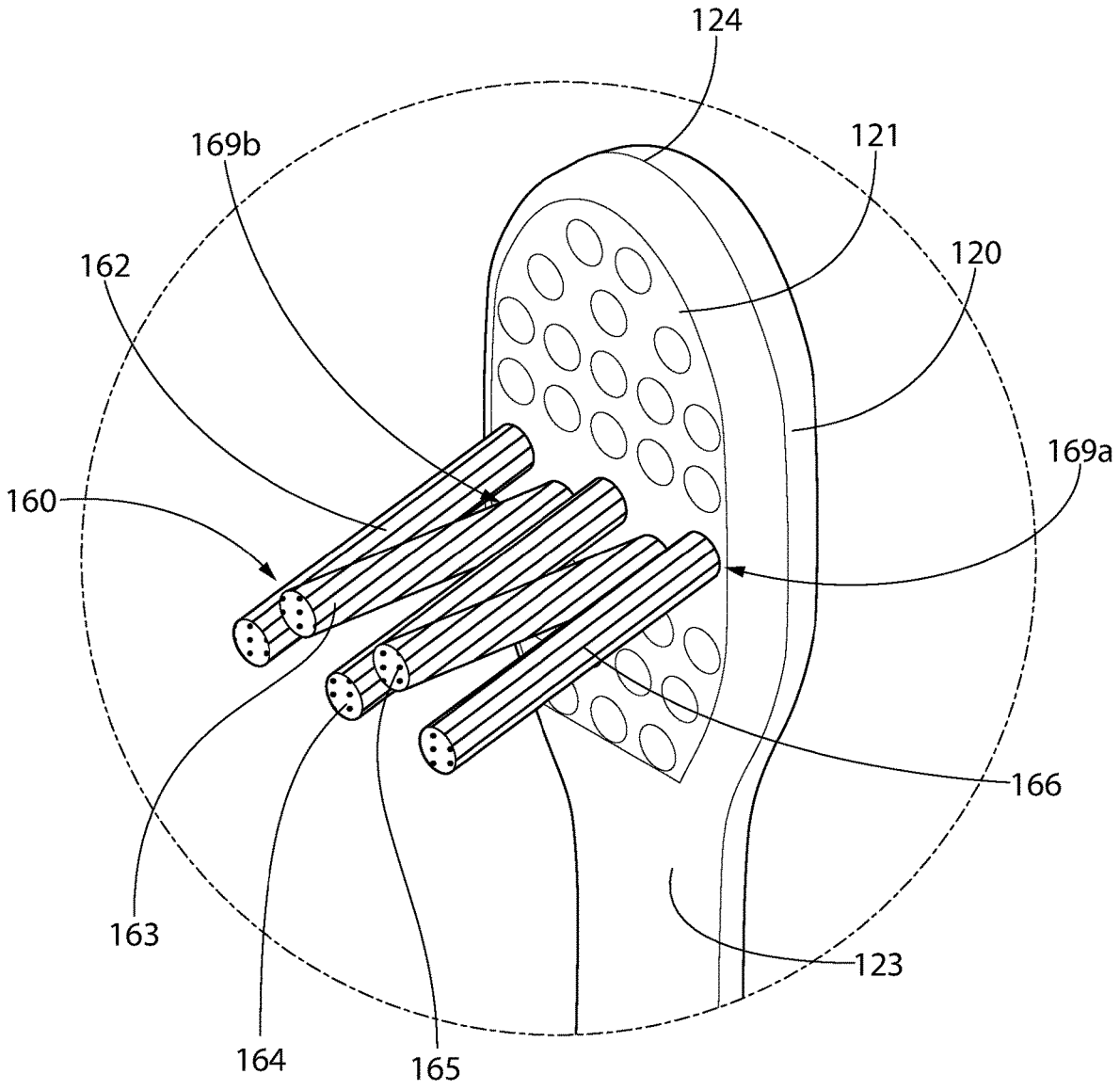
FIG. 13 is a perspective view of the head of the oral care implement of FIG. 1 with only a third group of cleaning elements thereon.
Figure 14:
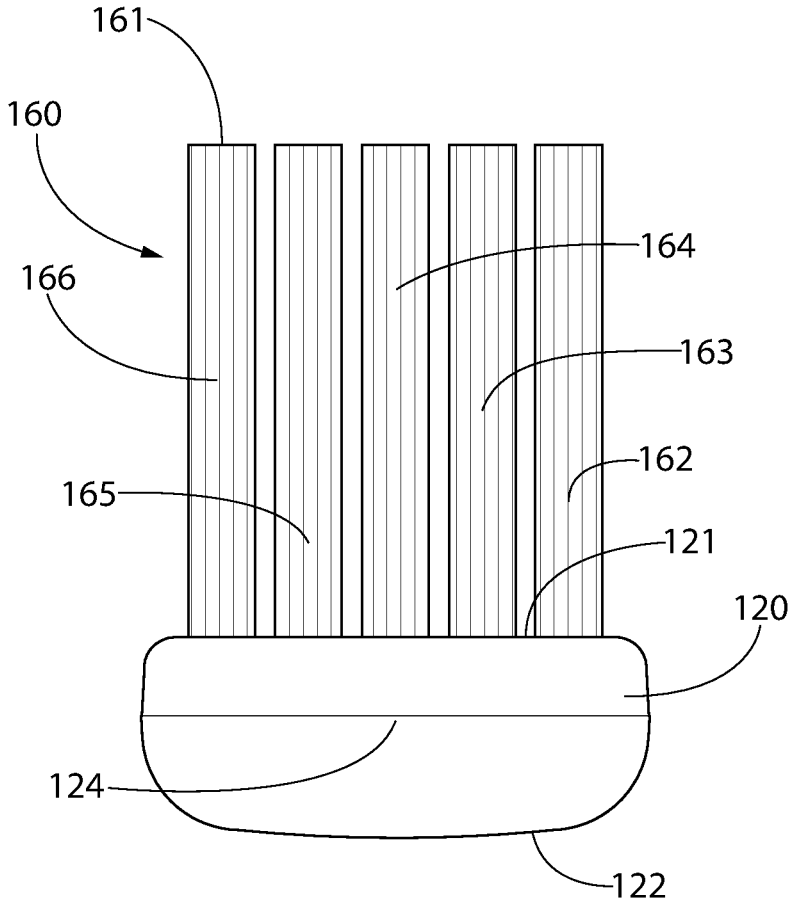
FIG. 14 is a top view of the head of the oral care implement of FIG. 1 with only the third group of cleaning elements thereon.
Figure 15:
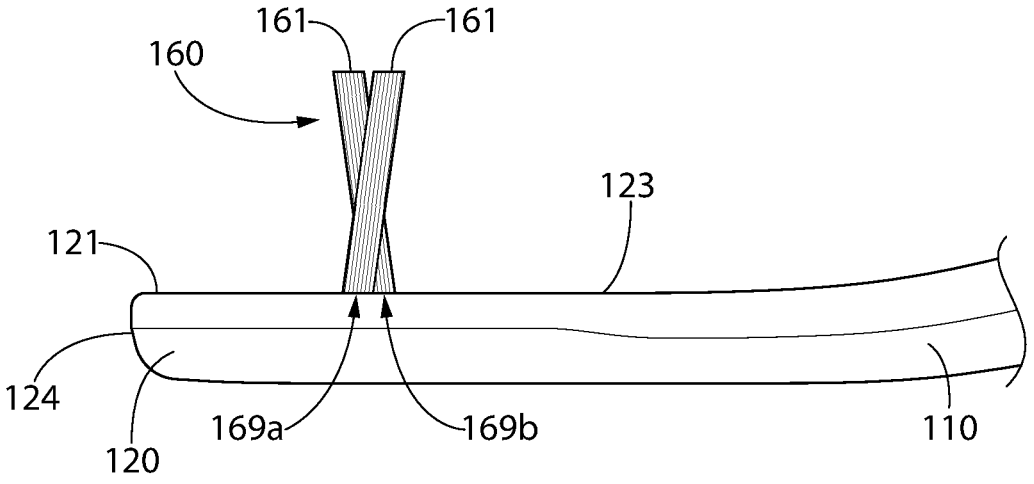
FIG. 15 is a side view of the head of the oral care implement of FIG. 1 with only the third group of cleaning elements therein.

Referring now to FIGS. 10-12, the second group of tooth cleaning elements 150 will be described in more detail. Each of the tooth cleaning elements of the second group 150 terminates in the distal end 151 as noted above. Furthermore, as seen from viewing FIGS. 10-12 collectively, the distal ends 151 of the second group of tooth cleaning elements 150 collectively form a cleaning surface S2 that is convex in both the longitudinal direction and the lateral direction. The cleaning surface S2 is illustrated in FIGS. 11 and 12. The cleaning surface S2 is a continuous surface formed by the distal ends 151 of the tooth cleaning elements of the second group 150 and the empty space between the distal ends 151 of adjacent ones of the tooth cleaning elements of the second group 150. Thus, if a flat and flexible object were placed into contact with the distal ends 151 of each and every one of the tooth cleaning elements of the second group 150, the object would be convex in both the lateral and longitudinal directions. In fact, the object would take on a dome-like shape with the surface of the dome that is exposed to a viewer looking down at the front surface 121 of the head 120 being convex.

FIG. 11 illustrates that the cleaning surface S2 formed collectively by the distal ends 151 of the tooth cleaning elements of the second group 150 is convex in the lateral direction (i.e., when viewed from the proximal 123 or distal 124 ends of the head 120). FIG. 12 illustrates that the cleaning surface S2 formed collectively by the distal ends 151 of the tooth cleaning elements of the second group 150 is convex in the longitudinal direction (i.e., when viewed from one of the sides of the head 120). The dome-like shape of the cleaning surface S2 in the lateral and longitudinal directions is achieved by varying the heights of the tooth cleaning elements of the second group 140, as discussed in greater detail below.

In the exemplified embodiment, the second group of tooth cleaning elements 150 is located adjacent to the distal end 124 of the head 120. More specifically, the second group of tooth cleaning elements 150 comprises a first row 156*a* of cleaning elements and a second row 156*b* of cleaning elements. The first row 156*a* of cleaning elements comprises first and second cleaning elements 152*a*, 153*a* that extend the same distance from the front surface 121 of the head 120. Each of the first and second cleaning elements 152*a*, 153*a* of the first row 156*a* gradually decrease in height in a direction from the longitudinal axis A-A of the head 120 towards the peripheral edge of the head 120. The second row 156*b* of cleaning elements comprises first and second peripheral cleaning elements 154*b* and a central cleaning element 155*b*. The central cleaning element 155*b* is taller than the first and second peripheral cleaning elements 154*b* (extends further from the front surface 121 of the head 120), which results in the convex cleaning surface S2 as described herein. This difference in height of the cleaning elements within each row 156*a*, 156*b* results in the cleaning surface S2 defined by the tooth cleaning elements of the second group 150 being convex in the lateral direction.

Furthermore, as best seen in FIG. 12, the cleaning elements of the first row 156*a* are taller than the axially adjacent cleaning elements of the second row 156*b*. As a result, the cleaning surface S2 formed by the distal ends 151 of the cleaning elements of the second group 150 are also convex in the longitudinal direction, as illustrated in FIG. 12.

Furthermore, in the exemplified embodiment, the convex cleaning surface S2 is even further defined by forming the distal ends 151 of the tooth cleaning elements of the second group 150 so as to be slightly curved, rounded, or otherwise angled relative to the front surface 121 of the head 120. Specifically, if the distal ends 151 were flat and parallel to the front surface 121 of the head 120, the cleaning surface S2 could not be a smooth convex surface. By curving, rounding, or otherwise angling the distal ends 151 of the tooth cleaning elements of the second group 150, the convex nature of the cleaning surface S2 is further enhanced. In the exemplified embodiment, the distal ends 151 of the cleaning elements of the first row 156*a* may be angled downwardly in a direction towards the distal end 124 of the head 120 and towards the lateral edges of the head whereas the distal ends 151 of the cleaning elements of the second row 156*b* may be angled downwardly in a direction towards the proximal end 123 of the head 120 and towards the lateral edges of the head. This enhances the appearance of the convex cleaning surface S2.

Turning to FIGS. 3 and 13-15, the third group of tooth cleaning elements 160 will be further described. As mentioned above, the third group of tooth cleaning elements 160 extends across an entirety of a width of the tooth cleaning element field 131 within the first group of tooth cleaning elements 140. However, the third group of tooth cleaning elements 160 are readily distinguishable from the first group of tooth cleaning elements 140 based in part on the orientation at which the tooth cleaning elements of the third group 160 extend from the head 120. Specifically, as noted above the tooth cleaning elements of the third group 160 are inclined relative to the front surface 121 of the head 120 rather than being perpendicular as with the tooth cleaning elements of the first and second groups 140, 150.

The third group of tooth cleaning elements 160 may be considered to be arranged in a first row 169*a* and a second row 169*b* that are slightly axially offset from one another. Specifically, the tooth cleaning elements in the first row 169*a* are slightly closer to the distal end 124 of the head 120 and the tooth cleaning elements in the second row 169*b* are slightly closer to the proximal end 123 of the head 120. Furthermore, the tooth cleaning elements in the first row 169*a* are inclined towards the proximal end 123 of the head 120 and towards the handle 110 whereas the tooth cleaning elements in the second row 169*b* are inclined towards the distal end 124 of the head 120 and away from the handle 110. The first and second rows 169*a*, 169*b* are arranged in an alternating fashion such that moving transversely across the head 120, each tooth cleaning element in the second row 169*b* is between two of the tooth cleaning elements in the first row 169*a*. Thus, moving transversely across the head 120, the third group of tooth cleaning elements 160 comprises a first tooth cleaning element 162 inclined towards the proximal end 123 of the head 120, a first tooth cleaning element 163 inclined towards the distal end 124 of the head 120, a second tooth cleaning element 164 inclined towards the proximal end 123 of the head 120, a second tooth cleaning element 165 inclined towards the distal end 124 of the head 120, and a third tooth cleaning element 166 inclined towards the proximal end 123 of the head 120.

Figure 16:
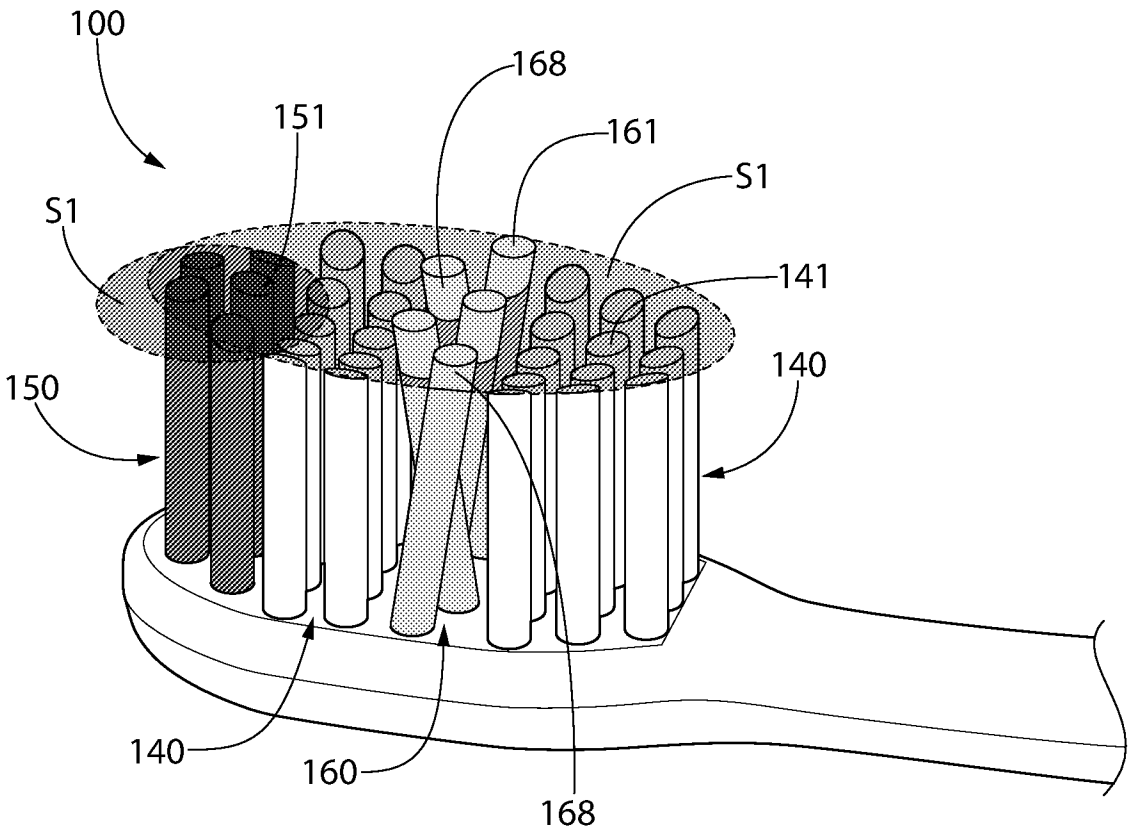
FIG. 16 is a perspective view of the head of the oral care implement of FIG. 1 illustrating concave and convex cleaning surfaces formed by distal ends of the cleaning elements.
Figure 17:
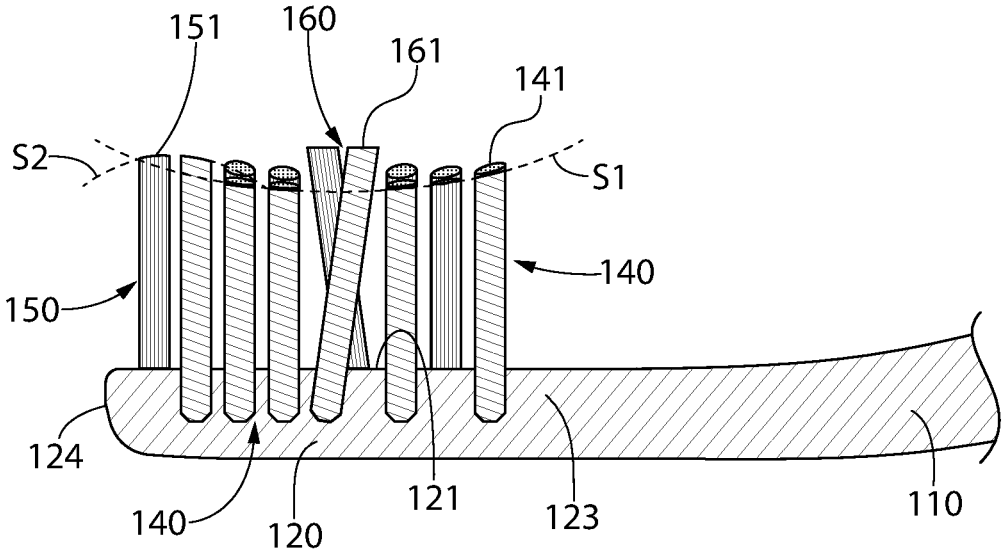
FIG. 17 is a cross-sectional view taken along the longitudinal axis A-A in FIG. 3.

Referring to FIGS. 16 and 17, the cleaning surfaces of the groups of tooth cleaning elements will be further described. FIG. 16 illustrates the first cleaning surface S1 formed by the distal ends 141 of the tooth cleaning elements of the first group 140 and the second cleaning surface S2 formed by the distal ends 151 of the tooth cleaning elements of the second group 150. This provides a better visual of the concave dome-like shape of the first cleaning surface S1 and the convex dome-like shape of the second cleaning surface S2. Similarly, FIG. 17 provides a good illustration of the concave shape of the first cleaning surface S1 in the longitudinal direction whereas, as discussed above, FIGS. 7 and 8 provide a good illustration of the concave shape of the first cleaning surface S1 in the lateral direction. Finally, FIG. 17 provides a good illustration of the convex shape of the second cleaning surface S2 in the longitudinal direction whereas, as discussed above, FIG. 11 provides a good illustration of the convex shape of the second cleaning surface S2 in the lateral direction.

Furthermore, referring to FIGS. 16 and 17, it can be seen that the tooth cleaning elements of the third group 160 protrude through the first cleaning profile S1 formed by the distal ends 141 of the tooth cleaning elements of the first group 140. This occurs because the third group of tooth cleaning elements 160 is positioned within the first group of tooth cleaning elements 140 and because the tooth cleaning elements 160 of the third group are each taller than each of the tooth cleaning elements of the first group 140. Thus, the tooth cleaning elements of the third group 160 have portions 168 that protrude through and extend from the concave cleaning surface S1.

Furthermore, in the exemplified embodiment the third group of tooth cleaning elements 160 is positioned so as to be located at a low-point of the concave reference surface S1 formed by the distal ends of the tooth cleaning elements of the first group 140. More specifically, the third group of tooth cleaning elements 160 is positioned at the lowest part of the concave reference surface S1. Thus, the tooth cleaning elements of the third group 160 are relatively significantly taller than the tooth cleaning elements of the first group 140 that are adjacent thereto. Specifically, in the exemplified embodiment between 15-20% of the length of the tooth cleaning elements of the third group 160 (measured from the front surface 121 of the head 120 to the distal ends 161 of the tooth cleaning elements of the third group 160) protrude above the concave reference surface S1 formed by the distal ends 141 of the tooth cleaning elements of the first group 140. This enhances the ability of the tooth cleaning elements of the third group 160 to penetrate into the interproximal spaces and the gumline during brushing.

In some embodiments, the concave shape of the first cleaning profile S1 may be useful for dosing of toothpaste. Specifically, the concave shape may have a holding capacity can be filled with an ideal amount of toothpaste for a single toothbrushing session. Additionally, the concave shape of the first cleaning profile S1 will hold the toothpaste better in place during toothbrushing. Furthermore, the concave shape of the first cleaning profile S1 facilitates drawing toothpaste and other cleaning fluids down towards the third group of tooth cleaning elements 160. The tooth cleaning elements of the third group 160 are the tallest and thus they may penetrate into the spaces between the teeth and at the gumline. In some embodiments the tooth cleaning elements of the third group 160, which are the tallest, may be tapered bristles to better enable those tooth cleaning elements to penetrate into the small spaces between teeth and at the gumline for effective cleaning. These are some of the more difficult areas to clean and ensuring that there is sufficient toothpaste or cleaning fluids provided to the third group of tooth cleaning elements 160 ensures that those regions are getting sufficiently cleaned during toothbrushing. Furthermore, the convex shape of the second cleaning profile S2 facilitates draining the toothpaste and other cleaning fluids down from the second group of tooth cleaning elements 150 onto the first group of tooth cleaning elements 140. Thus, the various shapes of the cleaning profiles/surfaces ensure that the toothpaste is adequately shared among the different regions of the oral care implement 100 and provides a comfortable brushing experience.

Furthermore, the different cleaning elements having different heights also affect the mouth feel during brushing. Specifically, longer cleaning elements are softer and better for gum access while shorter bristles are stiffer and better for cleaning and scrubbing. In the first group of tooth cleaning elements 140, the cleaning elements near the perimeter are taller and thus softer and better for gum cleaning. The cleaning elements near the perimeter are typically placed at the gumline during cleaning while the center of the cleaning element field 131 is positioned centrally over the teeth. Furthermore, in the first group of tooth cleaning elements 140, the cleaning elements located closer to the center, which will be contacting the centers of the teeth, are shorter and thus stuffer so that they can scrub plaque and debris from the teeth effectively.

Finally, referring to FIG. 16, in one embodiment the different groups of tooth cleaning elements 140, 150, 160 may be further distinguished based on color. Thus, as shown in FIG. 16, in one embodiment the first group of tooth cleaning elements 140 may have or be formed of a first color, the second group of tooth cleaning elements 150 may have or be formed of a second color, and the third group of tooth cleaning elements 160 may have or be formed of a third color. In such embodiment, the first, second, and third colors may all be different. This may enhance the aesthetics of the oral care implement 100 and/or be used as an indication of a feature of the tooth cleaning element. Specifically, different colors may denote different features or characteristics of the tooth cleaning elements. As an example only, the colors may denote that the tooth cleaning elements comprise an additive, are spiral bristles, are tapered bristles, or the like. The oral care implement 100 or its packaging may include a key to readily identify the meaning of the different colors.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. An oral care implement comprising:

a head extending along a longitudinal axis from a proximal end to a distal end, the head comprising a front surface;

a plurality of tooth cleaning elements extending from the front surface of the head and arranged in a tooth cleaning element field, the tooth cleaning element field comprising:

a first group of tooth cleaning elements, the tooth cleaning elements of the first group terminating in distal ends that collectively form a first cleaning surface that is concave in both a longitudinal direction and a lateral direction; and a second group of tooth cleaning elements located adjacent the first group of tooth cleaning elements, the tooth cleaning elements of the second group terminating in distal ends that collectively form a second cleaning surface that is convex in both the longitudinal direction and the lateral direction;

a third group of tooth cleaning elements disposed within the first group of tooth cleaning elements and protruding through the first cleaning surface, the tooth cleaning elements of the third group extending from the front surface in an inclined manner towards the proximal end of the head or towards the distal end of the head.

2. The oral care implement according to claim 1 wherein the second group of tooth cleaning elements are located adjacent the distal end of the head and the first group of tooth cleaning elements are located between the second group of tooth cleaning elements and the proximal end of the head.

3. The oral care implement according to claim 1 wherein the third group of tooth cleaning elements divides the first group of tooth cleaning elements into a first subgroup of tooth cleaning elements located between the second group of tooth cleaning elements and the third group of tooth cleaning elements and a second subgroup of tooth cleaning elements located between the third group of tooth cleaning elements and the proximal end of the head, the third group of tooth cleaning elements extending across an entirety of a width of the tooth cleaning element field and isolating the first subgroup of tooth cleaning elements from the second subgroup of tooth cleaning elements.

4. The oral care implement according to claim 3 wherein the head comprises a first axial section adjacent the distal end of the head and having only the second group of tooth cleaning elements located thereon, a second axial section adjacent the first axial section and having only the first subgroup of tooth cleaning elements of the first group of tooth cleaning elements located thereon, a third axial section adjacent the second axial section and having only the third group of tooth cleaning elements located thereon, and a fourth axial section located between the third axial section and the proximal end of the head and having only the second subgroup of tooth cleaning elements of the first group of tooth cleaning elements located thereon.

5. An oral care implement comprising:

a head extending along a longitudinal axis from a proximal end to a distal end, the head comprising a front surface;

a plurality of tooth cleaning elements extending from the front surface of the head and arranged in a tooth cleaning element field, the tooth cleaning element field comprising:

a first group of tooth cleaning elements, the tooth cleaning elements of the first group terminating in distal ends that collectively form a first cleaning surface that is concave in both a longitudinal direction and a lateral direction; and a second group of tooth cleaning elements located adjacent the first group of tooth cleaning elements, the tooth cleaning elements of the second group terminating in distal ends that collectively form a second cleaning surface that is convex in both the longitudinal direction and the lateral direction; and a third group of tooth cleaning elements that divides the first group of tooth cleaning elements into a first subgroup of tooth cleaning elements and a second subgroup of tooth cleaning elements, and wherein the first subgroup of tooth cleaning elements comprises a plurality of transverse rows of axially aligned tooth cleaning elements, and wherein a first portion of the first cleaning surface formed by the first subgroup of tooth cleaning elements is concave in both the lateral direction and the longitudinal direction.

6. An oral care implement comprising:

a head extending along a longitudinal axis from a proximal end to a distal end, the head comprising a front surface;

a plurality of tooth cleaning elements extending from the front surface of the head and arranged in a tooth cleaning element field, the tooth cleaning element field comprising:

a first group of tooth cleaning elements, the tooth cleaning elements of the first group terminating in distal ends that collectively form a first cleaning surface that is concave in both a longitudinal direction and a lateral direction; and a second group of tooth cleaning elements located adjacent the first group of tooth cleaning elements, the tooth cleaning elements of the second group terminating in distal ends that collectively form a second cleaning surface that is convex in both the longitudinal direction and the lateral direction; and a third group of tooth cleaning elements that divides the first group of tooth cleaning elements into a first subgroup of tooth cleaning elements and a second subgroup of tooth cleaning elements, and wherein pairs of adjacent tooth cleaning elements of the third group of tooth cleaning elements are inclined in opposite directions towards one of the proximal or distal ends of the head.

7. The oral care implement according to claim 6 wherein each of the tooth cleaning elements of the third group of tooth cleaning elements extend the same distance from the front surface of the head.

8. The oral care implement according to claim 7 wherein each of the tooth cleaning elements of the third group of tooth cleaning elements extends a greater distance from the front surface of the head than each of the tooth cleaning elements of the first and second groups of tooth cleaning elements.

9. The oral care implement according to claim 6 wherein the first group of tooth cleaning elements are a first color, the second group of tooth cleaning elements are a second color, and the third group of tooth cleaning elements are a third color, each of the first, second, and third colors being different.

10. An oral care implement comprising:

a head extending along a longitudinal axis from a proximal end to a distal end, the head comprising a front surface;

a plurality of tooth cleaning elements extending from the front surface of the head and arranged in a tooth cleaning element field, the tooth cleaning element field comprising:

a first group of tooth cleaning elements, the tooth cleaning elements of the first group terminating in distal ends that collectively form a concave cleaning surface;

a second group of tooth cleaning elements located adjacent the first group of tooth cleaning elements, the tooth cleaning elements of the second group terminating in distal ends that collectively form a convex cleaning surface; and a third group of tooth cleaning elements disposed within the first group of tooth cleaning elements and protruding through the concave cleaning surface, the tooth cleaning elements of the third group extending from the front surface in an inclined manner.

11. The oral care implement according to claim 10 wherein the third group of tooth cleaning elements divides the first group of tooth cleaning elements into a first subgroup of tooth cleaning elements and a second subgroup of tooth cleaning elements.

12. The oral care implement according to claim 11 wherein the third group of tooth cleaning elements isolates the first subgroup of tooth cleaning elements from the second subgroup of tooth cleaning elements.

13. The oral care implement according to claim 11 wherein a first portion of the concave cleaning surface formed by the first subgroup of tooth cleaning elements is concave in both a lateral direction and a longitudinal direction and a second portion of the concave cleaning surface formed by the second subgroup of tooth cleaning elements is concave in both the lateral direction and the longitudinal direction.

14. The oral care implement according to claim 10 wherein the third group of tooth cleaning elements comprises a first row of tooth cleaning elements inclined toward the proximal end of the head and a second row of tooth cleaning elements inclined toward the distal end of the head.

15. The oral care implement according to claim 10 wherein each of the tooth cleaning elements of the third group is taller than a tallest one of the tooth cleaning elements of the first group.

16. The oral care implement according to claim 10 wherein the second group of tooth cleaning elements is located between the distal end of the head and the first group of tooth cleaning elements.

17. An oral care implement comprising:

a head extending along a longitudinal axis from a proximal end to a distal end, the head comprising a front surface;

a plurality of tooth cleaning elements extending from the front surface of the head and arranged in a tooth cleaning element field, the tooth cleaning element field comprising a first group of tooth cleaning elements, a second group of tooth cleaning elements, and a third group of tooth cleaning elements, the third group of tooth cleaning elements dividing the first group of tooth cleaning elements into a first subgroup of tooth cleaning elements and a second subgroup of tooth cleaning elements; and wherein the tooth cleaning elements of the first subgroup of tooth cleaning elements terminate in distal ends that collectively form a cleaning surface that is concave in both a lateral direction and a longitudinal direction, wherein the tooth cleaning elements of the second subgroup of tooth cleaning elements terminate in distal ends that collectively form a cleaning surface that is concave in both the lateral direction and the longitudinal direction, and wherein the second group of tooth cleaning elements is located adjacent the first group of tooth cleaning elements, the tooth cleaning elements of the second group terminating in distal ends that collectively form a second cleaning surface that is convex in both the longitudinal direction and the lateral direction.

18. The oral care implement according to claim 17 wherein each of the tooth cleaning elements of the third group is taller than each of the tooth cleaning elements of the first group.

19. The oral care implement according to claim 17 wherein adjacent tooth cleaning elements of the third group of tooth cleaning elements are inclined in opposite directions either towards the proximal end of the head or towards the distal end of the head.

* * * * *